United States Patent [19]

Nigrelli, Sr.

[11] Patent Number: 4,633,655

[45] Date of Patent: Jan. 6, 1987

[54] CASE PACKER

[75] Inventor: Biagio J. Nigrelli, Sr., Kiel, Wis.

[73] Assignee: Nigrelli Systems, Inc., Kiel, Wis.

[21] Appl. No.: 602,527

[22] Filed: Apr. 20, 1984

[51] Int. Cl.[4] ..... B65B 5/06; B65B 7/20; B65B 43/28

[52] U.S. Cl. ..... 53/543; 53/48; 53/252; 53/284; 53/374; 53/566

[58] Field of Search ..... 53/48, 237, 252, 284, 53/374, 382, 383, 387, 458, 479, 491, 543, 566

[56] References Cited

U.S. PATENT DOCUMENTS

| | | | |
|---|---|---|---|
| 3,060,659 | 10/1962 | Blais et al. | 53/566 |
| 3,097,463 | 7/1963 | Neal et al. | 53/566 |
| 3,300,946 | 1/1967 | Martin | 53/566 X |
| 3,619,966 | 11/1971 | Goldsberry | 53/252 X |
| 3,990,572 | 11/1976 | Fishback | 53/48 X |
| 4,028,866 | 6/1977 | Langen | 53/252 X |
| 4,067,172 | 1/1978 | Paules | 53/566 X |
| 4,081,945 | 4/1978 | Calvert et al. | 53/374 X |
| 4,089,150 | 5/1978 | Heisler | 53/252 X |
| 4,159,610 | 7/1979 | Langen | 53/252 X |
| 4,358,918 | 11/1982 | Groom et al. | 53/252 X |

*Primary Examiner*—Fred Silverberg
*Assistant Examiner*—Michael D. Folkerts
*Attorney, Agent, or Firm*—Fuller, House & Hohenfeldt

[57] ABSTRACT

A case packer for loading open side cases and trays with generally upright articles includes apparatus for controlling the location of the case flaps during the loading operation. A pair of doors is interposed in the path of the articles being loaded. The articles contact the doors, which swing open to push the side flaps out of the way. A plow-like strip is employed to control the location of the case bottom flap. The case blanks are stored in generally vertical stacks in an open-bottom hopper. The blanks are folded and supported so that pulling the lowest blank downwardly partially unfolds the blank before it is deposited onto a conveyor. The conveyor completes the unfolding process while transporting the case to the article loading station.

4 Claims, 15 Drawing Figures

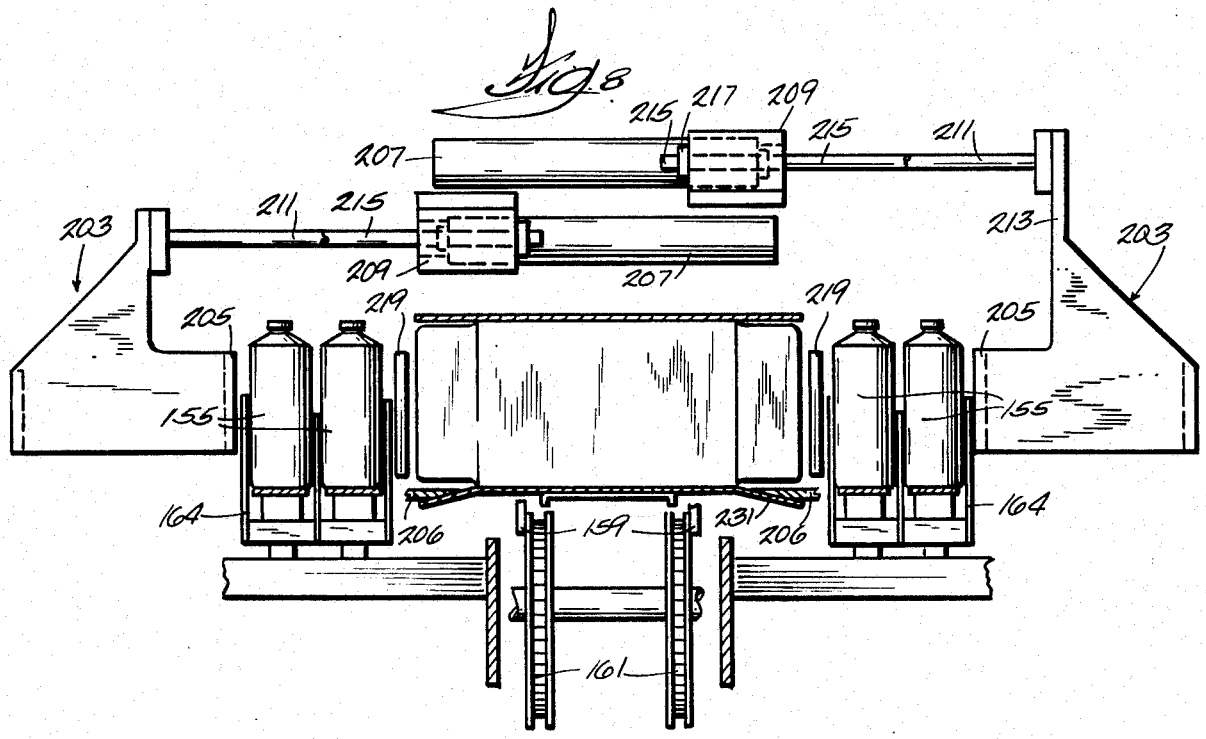
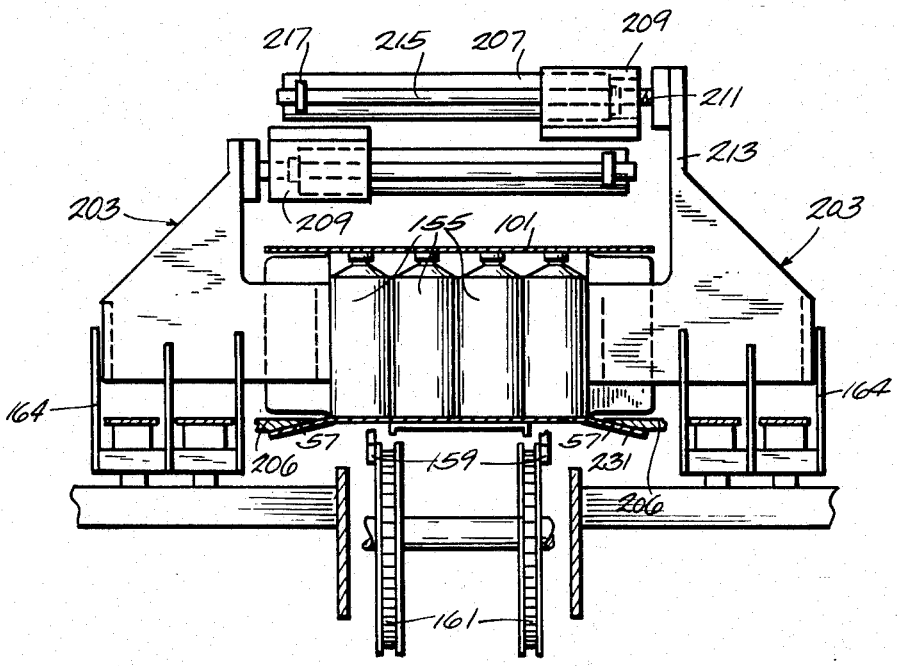
Fig. 9

CASE PACKER

BACKGROUND OF THE INVENTION

1. Field of the Invention

This invention pertains to apparatus for loading cases or trays and more particularly to apparatus for loading open side cases with the case flaps held in controlled locations during the loading process.

2. Description of the Prior Art

Various machinery has been developed to automatically load complements of upright articles into cases or trays made of paperboard and other materials. A common method is to load the articles from the top, that is, to load them into open top cases. Exemplary machinery for loading open top cases is disclosed in my co-pending U.S. patent application Ser. No. 438,214, filed Nov. 1, 1982, U.S. Pat. No. 4,531,345. However, use of my open top case loader requires modification to the standard articles to be loaded, as, for example, the addition of a flange to the necks of soft drink bottles. Other open top case loaders utilize complicated and expensive mechanical and electrical mechanisms to vertically maneuver the articles into the case, as may be seen in U.S. Pat. Nos. 2,615,289; 3,194;382; 3,599,397; and 3,864,890.

It is apparent that machinery for loading open side cases or trays has important advantages over open top case loaders, Loading an open side case eliminates vertical picking and placing motions. A related advantage is that the articles do not have to be modified to suit the particular mechanism employed to lift and/or drop them. A potential problem with open side cases is that, if the cases are closed by flaps, the flaps may have a tendency to interfere with the insertion of the articles. Thus, a need exists for open side case loading machinery that controls the location of the side flaps during the loading operation.

SUMMARY OF THE INVENTION

In accordance with the present invention, a case packer is provided that utilizes only horizontal motion to load upright articles into paperboard cartons or cases. This is accomplished by apparatus that includes a conveyor for transporting open side cases to a loading station where the cases are loaded simultaneously from opposite sides with complements of a predetermined number of articles. The loading mechanism comprises a pair of simple oppositely acting rams that horizontally push the complements from loading platforms into a waiting case in a quick and inexpensive manner. The articles to be loaded are conveyed to the loading station along paths that may parallel the motion of the empty cases.

Further in accordance with the present invention, the case packing apparatus controls the location of the flaps on three sides of the case during the loading operation. For that purpose, the articles being loaded open a pair of spring-loaded swinging doors as they are pushed into the case. The doors swing about vertical axes to bend the vertical or major flaps outwardly from the case opening, and lift the top flap upward, and thus out of the way of the inserted articles. When the rams have retracted from the inserted position, the doors close under the action of the springs. Under the influence of the swinging doors, the leading major flap on each side of the case is swung past the end of a vertical guide strip, the flap being bent slightly to clear the strip. When the doors close, the flaps are restrained by the strips in a direction approximately parallel to the direction of motion of the cases through the case loading machine. After leaving the loading station, the trailing major flap on each side is also restrained by the vertical guide strip to a parallel orientation.

To prevent interference between the bottom or minor flap and the incoming articles, a plow-like device folds the flap downwardly as the case is being transported to the loading station. The lower minor flap also passes under the loading platform to control its location at the loading station.

Controlling the case flaps during the loading process also enhances the flap closing and bonding process. Because the location of the flaps are fixed, only simple and inexpensive mechanisms of conventional construction are required to apply adhesive to the flaps and to close the flaps to produce an attractive and strong case.

The present invention is also concerned with apparatus for forming open side cases from a stack of appropriately scored flat-folded case blanks. The blanks are folded into an upper layer and a lower layer. The lower layer is notched on opposite edges. A stack of folded blanks is horizontally supported in a slanted open-bottom hopper by a pair of short low-friction fingers bearing against the lowest blank in the stack. In the preferred construction, the fingers pass through the notches in the lower layer to contact and support the underside of the upper layer.

To form an open side case from a folded and scored blank, a pair of suction cups reciprocate vertically to temporarily fasten to the underside of the case lower layer and to pull the lower layer downwardly. As the lower layer is being pulled downwardly, the blank bends at the scores to open slightly because the upper layer is constrained by the fingers from moving downwardly. As the lower layer is pulled further downwardly, the upper layer is ultimately pulled from between the fingers and the blank above. The suction cups continue to draw the partially unfolded blank downward to a waiting pair of flight bars, which fully open the case as they transport it to the loading station.

Other objects, advantages, and features of the invention will be apparent from the disclosure.

BRIEF DESCRIPTION OF THE DRAWINGS

FIG. 8 is an enlarged sectional view taken along lines 8—8 of FIG. 1 showing the loading station before the articles are inserted into an open side case;

FIG. 9 is a view similar to FIG. 8 but showing the loading station after the articles are loaded into an open side case.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figures 1, 3, 4:
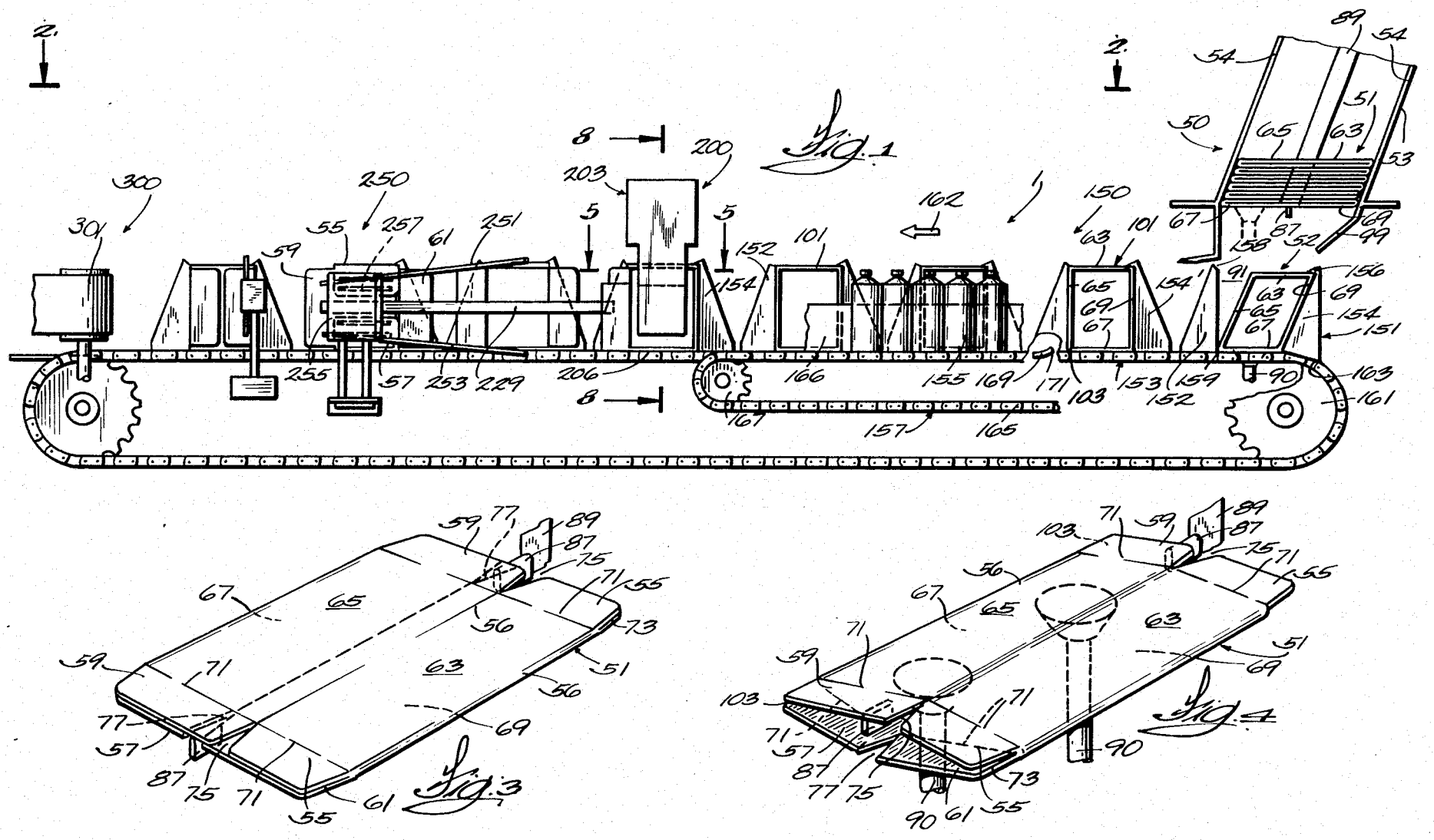
FIG. 1 is a partially broken side view of the case packer of the present invention.
FIG. 3 is a perspective view of an appropriately scored and folded case blank supported in a storage hopper a pair of fingers.
FIG. 4 is a perspective view showing the blank of FIG. 3 drawn downwardly from the hopper.
Figure 2:
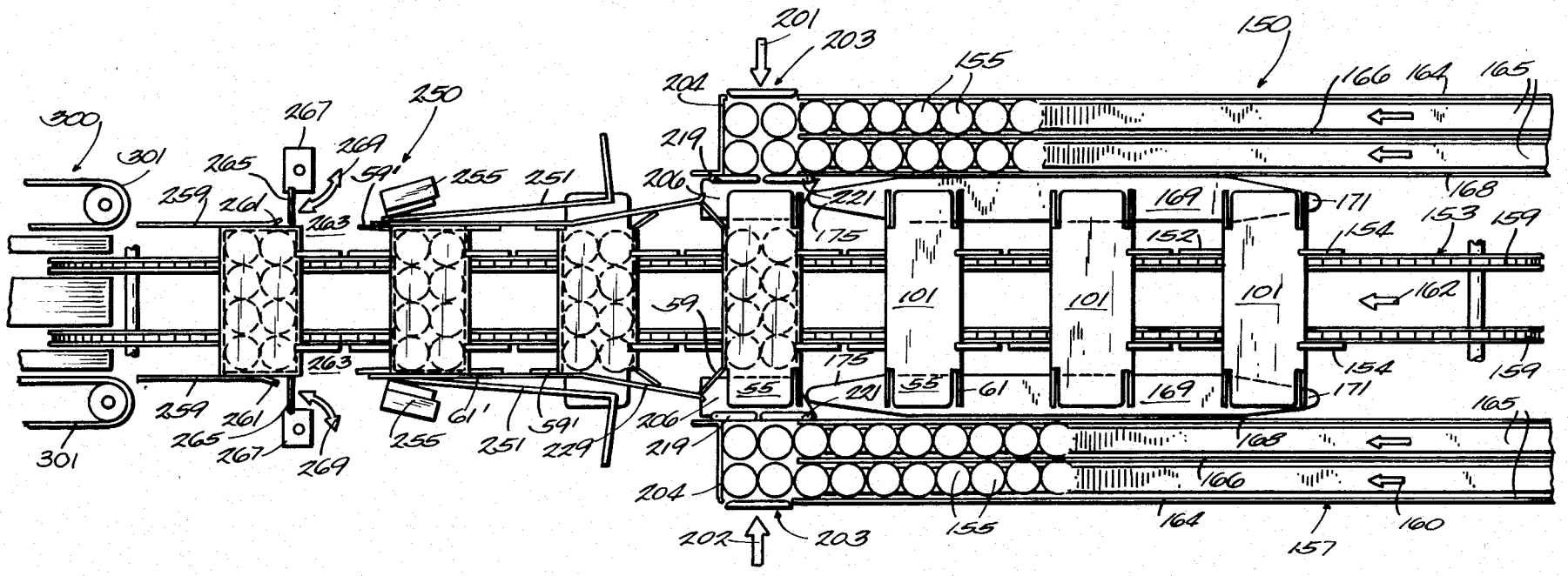
FIG. 2 is a view taken along lines 2—2 of FIG. 1.
Figure 5:
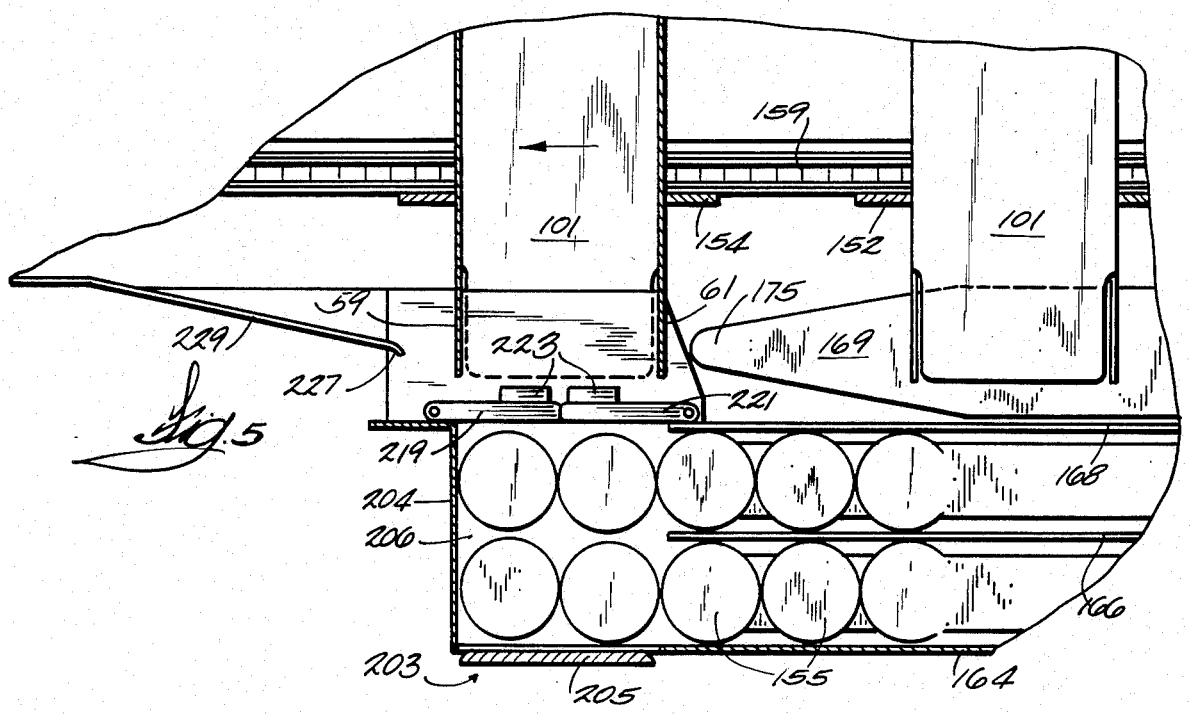
FIG. 5 is an enlarged sectional view taken along lines 5—5 of FIG. 1 showing in detail the loading station of the present invention.
Figure 6:
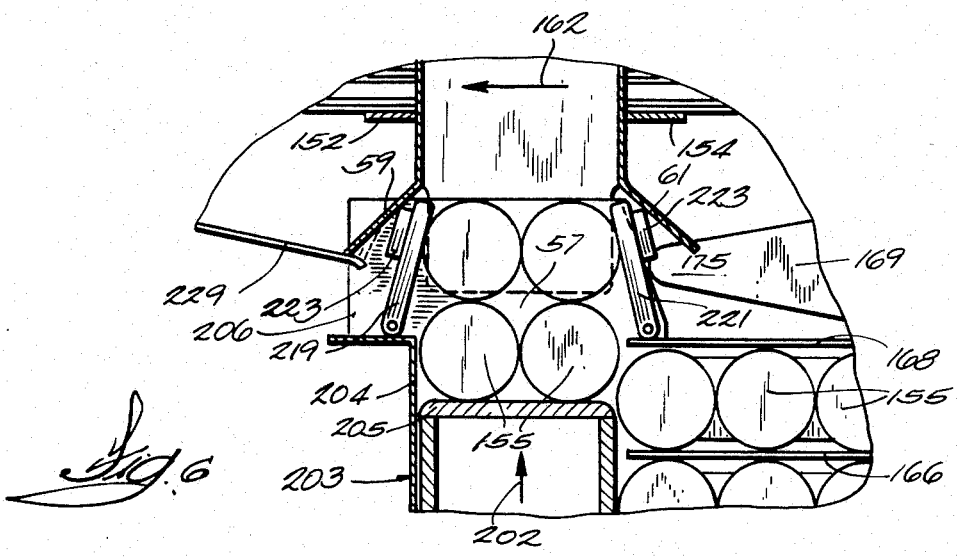
FIG. 6 is a sectional view similar to FIG. 5 but showing the articles as they are being loaded into an open side case.

Referring to FIGS. 1 and 2, an open side case packer 1 is illustrated that includes the present invention. The case packer finds particular usefulness for loading fluid-carrying aluminum bottles with recloseable caps into paperboard cartons or cases, but it will be understood that the invention is not limited to that application.

General

The case packer 1 includes a blank unloading station 50, a conveyor section 150, a loading station 200, a folding and bonding station 250, and a compression station 300.

Open side case blanks 51 are stored in an open bottom hopper 53. The blanks are withdrawn from the hopper and deposited in a partially opened condition 52 in a flight means 151 which completes the unfolding operation.

The open cases 101 are transported through conveyor section 150 by a case conveyor means 153 to loading station 200. At the loading station, complements of upright articles 155 are loaded simultaneously into both sides of the case. The articles to be loaded are transported to the loading station by a second conveyor means 157. At the loading station, the case flaps 57, 59, and 61 are restrained in a controlled fashion so as not to interfere with the loading operation.

The loaded cases, with the flaps held under controlled restraint, pass from the loading station 200 to a flap closing and bonding station 250.

To firmly set the adhesive applied at the bonding station, the loaded cases are compressed between two sets of vertical belts 301 at compression station 300.

Blank Unloading Station

Turning to FIGS. 1, 3, and 4, the operation of the blank unloading station 50 will be described. An open bottom hopper 53, having a pair of slanted but parallel sides 54, stores a quantity of folded carton or case, hereinafter case, blanks 51. The blanks are scored, as at lines 56, to form top, leading, bottom, and trailing sides 63, 65, 67, and 69, respectively. The blanks are preferably folded such that the top side 63 and the leading side 65 form the blank upper layer, and the bottom side 67 and trailing side 69 form the blank lower layer. Each side of the case blank terminates in a pair of flaps constructed by scoring the blank along lines 71 and partially slitting adjacent edges as at 73. The slits are constructed to form upper and lower V-shaped notches 75, 77, respectively. Thus, top side 63 terminates in flaps 55, bottom side 67 terminates in bottom flaps 57, leading side 65 terminates in leading flaps 59, and trailing side 69 terminates in trailing flaps 61. Preferably, the case trailing and leading sides are wider than the top and bottom sides; hence the leading and trailing flaps are referred to as the major flaps, and the top and bottom flaps are referred to as the minor flaps.

In accordance with the present invention, the blanks 51 are held in the hopper 53 by a pair of fingers 87 fastened to opposite sides of a hopper frame member 89. The fingers pass through the lower blank notches 77, FIG. 3, so that the fingers bear against the lower surface of leading flaps 59. To remove a folded blank from the hopper, the unloading station 50 includes a pair of attaching devices, such as suction cups 90, for temporarily attaching to the lower surface of bottom side 67, FIGS. 1 and 4. As the suction cups descend vertically, they pull bottom side 67 downwardly. Since the fingers restrain only the leading flaps 59 from moving downwardly, the blank starts to unfold as the suction cups descend, as illustrated in FIG. 4. As the suction cups continue their descent, the leading side 65 tilts counterclockwise as viewed in FIG. 1, and the leading flaps 59 are ultimately pulled from between the fingers and the next blank in the hopper. The suction cups finally deposit the partially opened case 52 in the space 91 between leading and trailing flight bars 152, 154, respectively, and under hook 156 in flight bar 154, FIG. 1. At that point, the suction cups release the blank. To assist guiding the blank into space 91, the upper portion of flight bar 152 is fabricated with a bevel 158, and the lower portion of the hopper has an angular guide 99.

Conveyor Section

Figure 10:
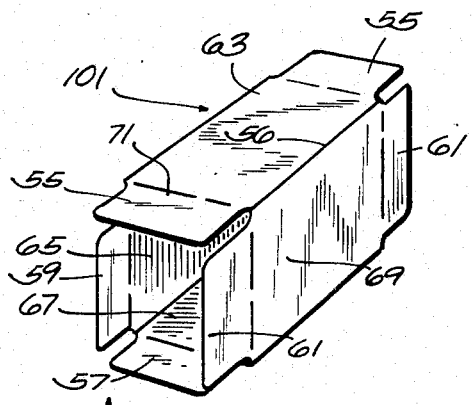
FIGS. 10-15 are perspective views of an open side case as it progresses through the case packer.
Figure 11:
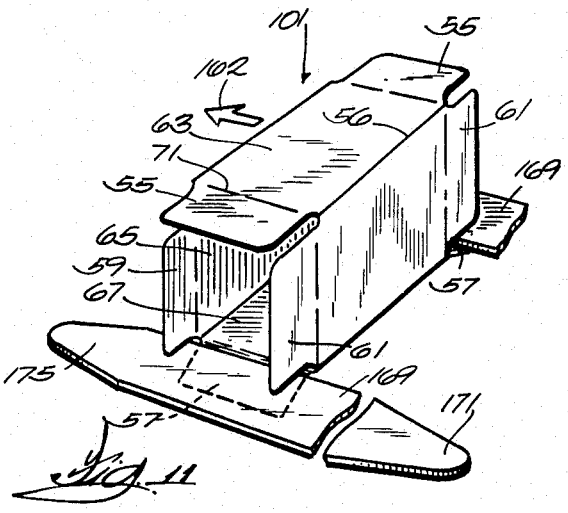
Figure 12:
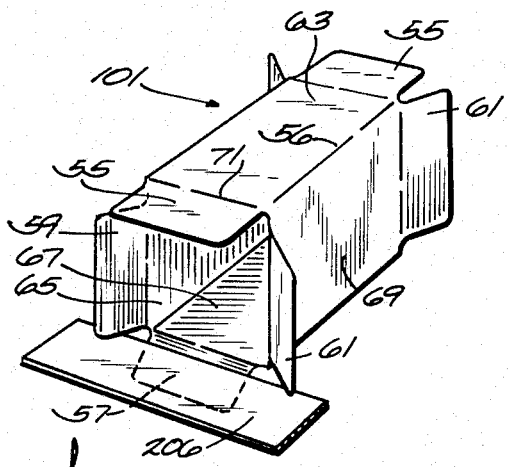

The flight bars 152 and 154 are fastened to a pair of conventional chains 159 that are driven through sprockets 161 by a conventronal power transmission, not shown (see FIGS. 1, 2, 5, 8, and 9). To create space 91 and accommodate the partially opened case 52, flight bar 154 is tilted backward relative to flight bar 152, FIG. 1. This is accomplished by locating the sprocket 161 such that the base 163 of flight bar 154 is not horizontal but is on the sprocket periphery when a blank 51 is withdrawn from the hopper 53 by the suction cups 90. As the flight bar 154 travels around the sprocket in the direction of arrow 162, it attains the attitude as shown at 154'. In attaining that attitude, it squares the case 52 to the completely unfolded configuration depicted at 101, FIGS. 1 and 10. The hooks 156 prevent the case from sliding upwardly on flight bar 154 as the case is being squared.

Reference numeral 157 indicates an article conveying means for transporting the articles 155, such as aluminum cans, in the direction of arrows 160 to the loading station 200, FIG. 2. The conveyor means comprises a pair of conventional plate-type chains 165 on each side of the case conveyor chains 159. The article conveying chains 165 are driven in timed relationship to the case conveyor chains through sprockets 167 by well known drive means, not illustrated in FIGS. 1 and 2. To insure an orderly distribution of the articles, they are separated into two rows by vertical dividers 164, 166, and 168, FIGS. 2, 5, 6, 7, 8, and 9.

For aiding in the article loading operation, the conveyor section 150 includes a pair of plows 169, FIGS. 2, 5, 6, and 11. The upstream end 171 of each plow preferably slants upwardly a slight amount to enter the notch 103 between the bottom flap 57 and the leading flap 59, FIGS. 1, 2, 4, and 11. Consequently, as the case 101 is transported by conveyor means 153 in the direction of arrow 162, the bottom flap 57 is restrained downwardly in a controlled manner.

Loading Station

At loading station 200, the articles 155 are loaded into both open ends of the cases 101. This is accomplished in a quick and inexpensive manner by pushing a complement of the desired number of articles simultaneously in the directions of arrows 201 and 202 by a pair of opposed rams 203, FIGS. 2, 5, 6, 8, and 9. In the illustrated embodiment, a complement of four articles is loaded into each side of the case, but that number is merely illustrative. To insure the presence of both a case and the correct number of articles at the loading station, a limit switch and an article counter are installed in the case and article paths, respectively, leading to the loading station; both are of well known construction and operation and are not illustrated herein.

The construction and operation of the loading station is the same for both sides; therefore, a description of one side is sufficient. The article conveyor means 157 conveys the articles 155 onto loading platform 206, which is preferably made of a low friction synthetic material such as HI-FAX Teflon. At the loading platform, the articles are prevented from further movement in the direction of arrows 160 by end plate 204. The complement of articles on the loading platform is pushed by face 205 of ram 203 into the open side case 101. (See FIGS. 1, 2, 5, 6, 7, 8, and 9) To actuate the ram 203, a pair of linear actuators 207 is mounted to a stationary frame member 209. In the illustrated embodiment, the actuators are fluid cylinders having their piston rods 211 fastened to ram housing 213, FIGS. 8 and 9. A guide rod 215 with stop 217 is slideably mounted on both sides of piston rod 211 within the frame member 209 for supporting ram 203 at ram housing 213. Preferably, face 205 is of a low friction wear resistant synthetic material such as HI-FAX Teflon.

To be certain the flaps of case 101 do not interfere with the articles 155 during the loading operation, the present invention includes apparatus for restraining the flaps in a controlled location during loading. In the preferred embodiment, the leading and trailing, or major, flaps 59 and 61, respectively, are controlled by a pair of symmetrical swinging doors 219 and 221, FIGS. 2, 5, 6, and 7. The doors 219 and 221 pivot about vertical axes on conventional hinges mounted to end plate 204 and inner divider 168, respectively. The doors are biased to the closed position of FIGS. 1, 5, and 7 by conventional torsion springs, not shown. The doors are provided with bumpers 223. As ram 203 advances to push the complement into the case, the articles contact and open the doors, FIG. 6. The bumper on door 219 contacts leading flap 59 and rotates it out of the way of the incoming articles. The flap 59 rotates past the leading end 227 of a horizontally extending guide strip 229. The bumper bends the flap 59 slightly to enable the flap to clear the end 227. The bumper on door 221 rotates trailing flap 61 out of the path of the incoming articles. Upon retraction of ram 203 and closing of the doors, leading flap 59 is restrained in a controlled location by guide strip 229. Trailing flap 61 may tend to resiliently close slightly. To control the location of bottom flap 57 at the loading station 200, the loading platform 206 is provided with a bevel 231 that catches the flap as the flap leaves the downstream end 175 of plow 169, FIGS. 5–9, and 12. I have discovered that top flap 55 attains a horizontal attitude after the case 52 is squared and that the flap does not droop during conveyance to the loading station. Hence the location of the top flap is not controlled at the loading station.

Figure 7:
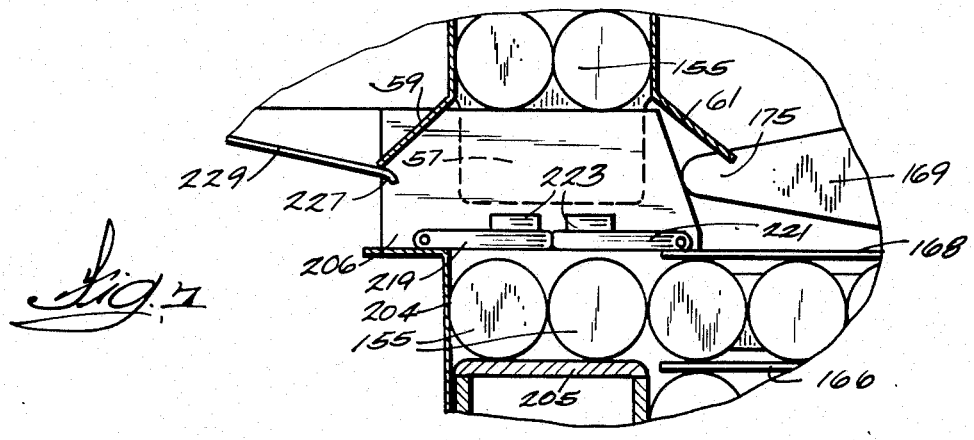
FIG. 7 is a view similar to FIGS. 5 and 6 but showing a fully loaded open side case.

After the case 101 has been side loaded, FIGS. 7 and 9, the case passes to folding and bonding station 250, FIGS. 1 and 2. The apparatus and operation of both sides of the folding and bonding station are identical; therefore, only one side will be described. It will be noticed in FIGS. 2, 5, 6, and 7 that guide strips 229 taper inwardly in the downstream direction. Consequently, as the case conveyor means 153 advances the case in the direction of arrow 162, leading flap 59 is forced to a completely open position as indicated at 59' in FIG. 2. Trailing flap 61 is similarly forced to a completely open position as indicated at 61'.

Figure 13:
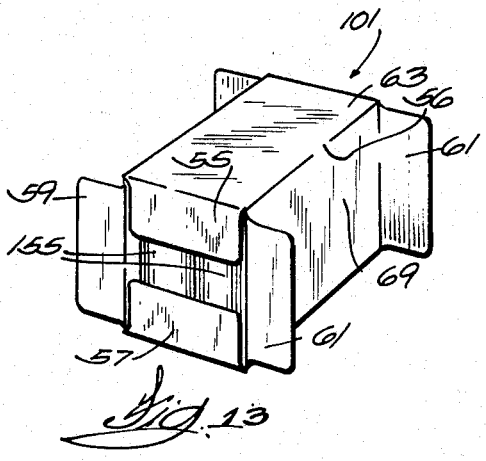

At the same time the major flaps are being completely opened, the minor flaps are being closed. For that purpose, each side of the case packer 1 is provided with upper and lower folding bars 251 and 253, respectively, FIGS. 1 and 2. The upstream ends of the folding bars 251 and 253 are positioned higher and lower than the top and bottom flaps 55 and 57, respectively, FIG. 1. The folding bars converge vertically in the downstream direction. As the loaded case is transported past the folding bars, the bars funnel the minor flaps between them to bend them toward the closed position. To complete the closing operation of the minor flaps, the bars 251 and 253 slant inwardly toward the center of the case packer 1, FIG. 2. Thus, when the loaded case has reached the downstream end of the folding bars, the minor flaps are fully closed, FIGS. 1 and 13.

Figure 14:
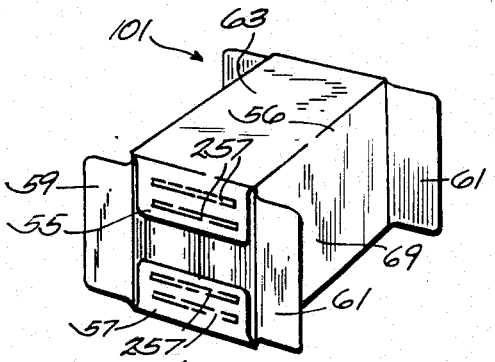

With the minor flaps closed, the case continues past an adhesive applicator 255, FIG. 1, that may be of the glue dispensing type. Preferably, the applicator squirts four horizontal lines 257 of glue onto the minor flaps, with two lines of glue on each flap, FIGS. 1 and 14.

While the adhesive is being applied to the minor flaps, the major flaps 59 and 61 are restrained in locations 59' and 61' by guide strip 229. The major flaps are folded over onto the minor flaps 55 and 57 by apparatus that includes a folding rail 259, FIG. 2. The upstream end of the folding rail is angled outwardly. There is a gap 263 between the downstream end of the guide strip 229 and the upstream end 261 of the folding rail. As the case 101 is transferred past the gap 263, the leading flap 59 tends to close due to the resilience of the case material. Consequently, the leading flap strikes the folding rail at the upstream end, and, with continued motion of the case, the folding rail completely closes the leading flap against the minor flaps.

To close the trailing flaps 61 against the minor flaps 55 and 57, a generally U-shaped rod 265 is mounted to a head 267. The head 267 oscillates about a vertical axis, as depicted by arrows 269. The oscillations of the head are timed such that the rods 265 contact the trailing flaps when the flaps are in the gaps 263 and after they have partially closed due to the paperboard resilience. The rods completely fold the trailing flaps against the minor flaps. As the case continues downstream, the trailing flaps are restrained in the closed position by folding rails 259.

Figure 15:
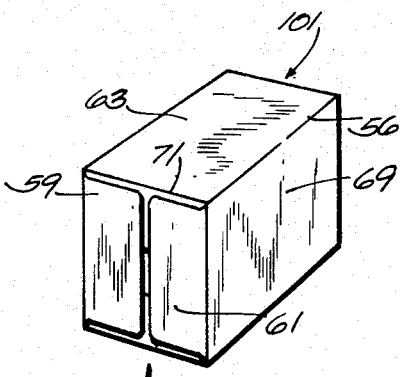

To firmly set the adhesive between the major and minor flaps, the cases 101 are compressed between the vertical belts 301 of a conventional compression station 300, FIG. 2. From the compression station, the loaded and sealed cases, as shown in FIG. 15, may be conveyed to additional stations for further processing, such as inspection and shipping.

Thus, it is apparent that there has been provided, in accordance with the invention, a side case packer that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and broad scope of the appended claims.

I claim:

1. Apparatus for loading open side cases having opposed pairs of leading and trailing vertical flaps and top and bottom horizontal flaps for closing the case sides, adjacent flaps being separated by notches, comprising:

(a) an open-bottom hopper for storing a plurality of folded case blanks in a generally vertical stack, the case blanks being folded into an upper layer and a lower layer, the blanks lying in a substantially horizontal plane in the hopper;

(b) stationary finger means mounted on the hopper to support the lowest blank in the stack;

(c) pulling means for pulling the lowest blank vertically downwardly from between the finger means and the next lowest blank in the stack and for partially opening the blank;

(d) case conveyor means for receiving and completely unfolding the partially unfolded case blanks into open side cases and for transporting the cases along a first path comprising:

(i) at least one pair of flight bars consisting of a leading and a trailing flight bar and defining a space therebetween for receiving a partially unfolded case blank from the pulling means and for holding the case while it is opened and transported;

(ii) chain and sprocket means for positioning the space between the flight bars vertically beneath the hopper to receive a partially opened blank;

(iii) drive means for driving the chain and sprocket means in synchronization with the pulling means; and (iv) a pair of stationary plows lying in a substantially horizontal plane and having upstream ends adapted to enter the notches between the opposed pairs of leading vertical flaps and adjacent bottom horizontal flaps to control the location of the bottom horizontal flaps as the chain and sprocket means transports the cases along the first path between the hopper and case loading means, each plow having a downstream end;

(e) article conveyor means for conveying a multiplicity of generally upright articles along a pair of second paths;

(f) case loading means for receiving the open side cases and articles and for simultaneously side loading a case from both sides with complements of a predetermined number of the articles;

(g) flap control means located on each side of the case loading means and actuated by the articles being loaded for restraining the location of the opposed vertical case flaps while the articles are being loaded into a case from both sides thereof;

(h) folding and bonding means for folding and applying adhesive to the flaps to form a closed case; and (i) compression means for setting the adhesive.

2. The apparatus of claim 1 wherein the case loading means comprises:

(a) a pair of loading platforms for receiving the articles from the article conveyor means and for accumulating the articles on both sides of the case conveyor means prior to loading them into the case;

(b) a frame;

(c) a pair of opposed rams adapted to reciprocate horizontally over the loading platform in a direction perpendicular to the direction of the cases transported along the first path to push the articles from the loading platform into the case;

(d) a pair of oppositely acting fluid cylinders mounted to the frame, each fluid cylinder having a piston rod fastened to a ram for reciprocating actuation thereof;

(e) guide means for reciprocably supporting the rams in the frame, and means for actuating the cylinders to cause the rams to move simultaneously to push a complement of articles from both loading platforms into both sides of the open side case.

3. The apparatus of claim 2 wherein the undersides of the loading platforms are beveled to catch the case bottom horizontal flaps to retain the controlled locations thereof when the bottom horizontal flaps pass the downstream ends of the plows as the chain and sprocket means transport the case along the first path.

4. The apparatus of claim 2 wherein the flap control means comprises:

(a) a pair of doors interposed in the path of the articles being loaded into a waiting case by each ram, the doors being contacted and swingably openable symmetrically about vertical axes by the articles being loaded, the doors being adapted to contact and rotate the case vertical flaps; and (b) spring means for closing the doors after the articles have been loaded into the case, so that the articles being loaded by the rams contact and open the doors to rotate the case vertical flaps out of the way of the incoming articles and the doors swing closed by the spring means when the ram has withdrawn after loading the case.

* * * * *